US011204208B1

(12) United States Patent
Aitken

(10) Patent No.: US 11,204,208 B1
(45) Date of Patent: Dec. 21, 2021

(54) BOLT CARRIER FOR MAGAZINE-FED FIREARM

(71) Applicant: Shari LeGate, Ltd, Glendale, AZ (US)

(72) Inventor: Richard Newton Aitken, Glendale, AZ (US)

(73) Assignee: Shari LeGate, Ltd., Glendale, AZ (US)

( * ) Notice: Subject to any disclaimer, the term of this patent is extended or adjusted under 35 U.S.C. 154(b) by 0 days.

(21) Appl. No.: 16/946,410

(22) Filed: Jun. 19, 2020

(51) Int. Cl.
*F41A 3/26* (2006.01)
*F41A 9/24* (2006.01)

(52) U.S. Cl.
CPC . *F41A 3/26* (2013.01); *F41A 9/24* (2013.01)

(58) Field of Classification Search
CPC ..... F41A 3/26; F41A 3/64; F41A 9/24; F41A 9/40–41; F41A 9/54; F41A 9/58; F41A 9/61; F41A 9/64–65; F41A 17/38; F41A 19/57
USPC ..... 42/14, 16–18, 49.02, 69.02; 89/33.1
See application file for complete search history.

(56) References Cited

U.S. PATENT DOCUMENTS 2,950,653 A * 8/1960 Harvey ..... F41A 3/26 89/185
2,951,424 A 9/1960 Stoner
2,960,917 A * 11/1960 Lizza ..... F41A 3/26 89/190
2,971,441 A * 2/1961 Reed ..... F41A 3/78 89/130
3,236,155 A 2/1966 Sturtevant
3,776,095 A * 12/1973 Atchisson ..... F41A 11/02 89/128
4,579,034 A * 4/1986 Holloway ..... F41A 3/26 42/18
5,551,179 A * 9/1996 Young ..... F41A 3/12 42/16
6,000,161 A * 12/1999 Aalto ..... F41A 3/18 42/16
6,209,249 B1 4/2001 Borden
6,978,709 B2 * 12/2005 Aalto ..... F41A 3/30 89/185
7,975,595 B2 * 7/2011 Robinson ..... F41A 21/485 89/185
8,307,750 B2 * 11/2012 Vuksanovich ..... F41A 3/26 89/191.01
8,375,616 B2 * 2/2013 Gomez ..... F41A 5/24 42/16
8,713,833 B2 5/2014 Lewis et al.
9,658,011 B2 5/2017 Gomez
9,791,224 B1 * 10/2017 Russo ..... F41A 3/66
(Continued)

OTHER PUBLICATIONS

"Fixing Magazine Malfunctions", Stag Arms Blog, www.info.stagarms.com, 14 pages, copyright 2017.

*Primary Examiner* — Troy Chambers
*Assistant Examiner* — Benjamin S Gomberg
(74) *Attorney, Agent, or Firm* — McKee, Voorhees & Sease, PLC

(57) ABSTRACT

A bolt carrier that facilitates seating a full magazine in the lower receiver of a magazine-fed gas-operated firearm with the bolt in a closed position. The bolt carrier includes a recessed portion that aligns with a top cartridge in a full magazine when the bolt carrier is in a closed position to provide additional space for the full magazine to be inserted into the magazine well. The recessed portion provides a space for the top cartridge to nest when the bolt carrier is in the closed position.

7 Claims, 10 Drawing Sheets

(56) References Cited

U.S. PATENT DOCUMENTS

| | | | | |
|---|---|---|---|---|
| 9,885,528 | B2 * | 2/2018 | Mather | F41A 3/30 |
| 10,041,750 | B2 * | 8/2018 | Oglesby | F41A 5/24 |
| 10,458,731 | B2 | 10/2019 | Mather | |
| 10,627,177 | B2 * | 4/2020 | Hamilton | F41A 3/22 |
| D883,421 | S * | 5/2020 | Grommet | F41A 23/08 D22/108 |
| 2013/0152443 | A1 | 6/2013 | Gomez et al. | |
| 2015/0198394 | A1 * | 7/2015 | Hochstrate | F41A 9/61 42/17 |
| 2018/0087857 | A1 * | 3/2018 | Davis | F41A 5/02 |
| 2018/0164056 | A1 | 6/2018 | Mather | |
| 2020/0011625 | A1 * | 1/2020 | Kramer | F41A 9/41 |

* cited by examiner

BOLT CARRIER FOR MAGAZINE-FED FIREARM

FIELD OF THE INVENTION

This invention relates generally to firearms and more particularly to an improved bolt carrier that facilitates seating a full magazine in the lower receiver of a magazine-fed gas-operated firearm with the bolt in a closed position.

BACKGROUND OF THE INVENTION

Magazine-fed gas-operated firearms, such as the M16 and its civilian counterparts the AR-15 and AR-15-like firearms, use a bolt carrier that shuttles forward and rearward to bring a bolt into a closed firing position in engagement with a rifle barrel and an open position spaced rearward away from the barrel. In the closed firing position, the forward portion of the bolt carrier is positioned directly above a magazine that supplies ammunition. After the firearm is fired, hot gas from the fired cartridge impinges on the bolt carrier to urge it rearward away from the barrel to permit the empty casing of the spent cartridge to be expelled. A spring that is compressed by the rearward motion of the bolt carrier propels the bolt carrier forward towards the barrel. A lower portion of the bolt, extending from the front end of the bolt carrier strips a cartridge from the magazine and loads the stripped cartridge into the barrel as the bolt carrier continues to move forward into the closed position.

The ammunition magazine is a removable clip that seats in a magazine well in a lower receiver portion of the firearm. As noted above, when the bolt carrier is in the closed firing position, a portion of the bolt carrier is located directly above the cartridges in the magazine. In this closed position the bolt carrier can interfere with the seating of a full magazine. Accordingly, it can be difficult to reload such a firearm without retracting the bolt carrier to the open position, for example with a charging handle. In most situations this is preferred as the safest alternative. However, in emergency situations, such as combat or a firelight it may be desired to reload with the bolt in a closed position firing position and a live round in the chamber.

This problem has been recognized for many years without an effective solution. The typical "solution" is to load fewer rounds of ammunition than the full capacity of the clip. For example, in a 30-round clip a user may only load a total of twenty-five (25) rounds so that there is more give or play with the top round in the clip such that the magazine will seat in the magazine well. However, this requires a user to carry more clips and reload more often or carry fewer total rounds. Alternatively, a user may be able to overcome the interference by banging or more forcefully inserting the magazine. However, this depends upon the strength and dexterity of the user, is not feasible in all situations, and can be especially dangerous in combat because it can be a noisy process.

Therefore, there is a need for an improved magazine-fed gas-operated firearm that overcomes these disadvantages.

SUMMARY OF THE INVENTION

According to one embodiment the invention relates to a bolt carrier that includes a recessed portion that aligns with the top cartridge in a full magazine to provide additional space for the magazine to be fully inserted into a magazine well without interference between the top cartridge and the bolt carrier.

According to another embodiment the invention relates to bolt carrier for a firearm wherein the firearm includes a barrel having a loading end and a firing end opposite from the loading end, the firearm further having a magazine well for receiving and seating a magazine containing cartridges, wherein the bolt carrier slides between an open position wherein a bolt is moved away from the barrel and a closed position wherein the bolt is in close contact with the loading end of the barrel, and further wherein when the bolt carrier is in the closed position at least a portion of the bolt carrier is aligned directly above the magazine well. The bolt carrier has an elongated body having a front end with an axial bore for retaining a portion of the bolt. A lower surface of the elongated body is proximate to the magazine well when the bolt carrier is in the closed position. A recessed portion in the lower surface of the bolt carrier is located to be aligned with a top cartridge in a full magazine within the magazine well such that the top cartridge nests partially within the recessed portion. The recessed portion may have a sufficient depth such that contact between the top cartridge and the lower surface of the elongated body does not interfere with seating the magazine in the magazine well when the magazine has a full load of cartridges. The recessed portion may have a radius equal to or greater than the radius of the cartridges. The recessed portion may be offset from a centerline of the elongated body in order to be in alignment with the top cartridge. The bolt carrier may be adapted for use in a gas-operated firearm. The bolt carrier may be adapted for use in an AR-15 style firearm. The bolt carrier may be adapted for use in an M16-style firearm.

Figure 1:
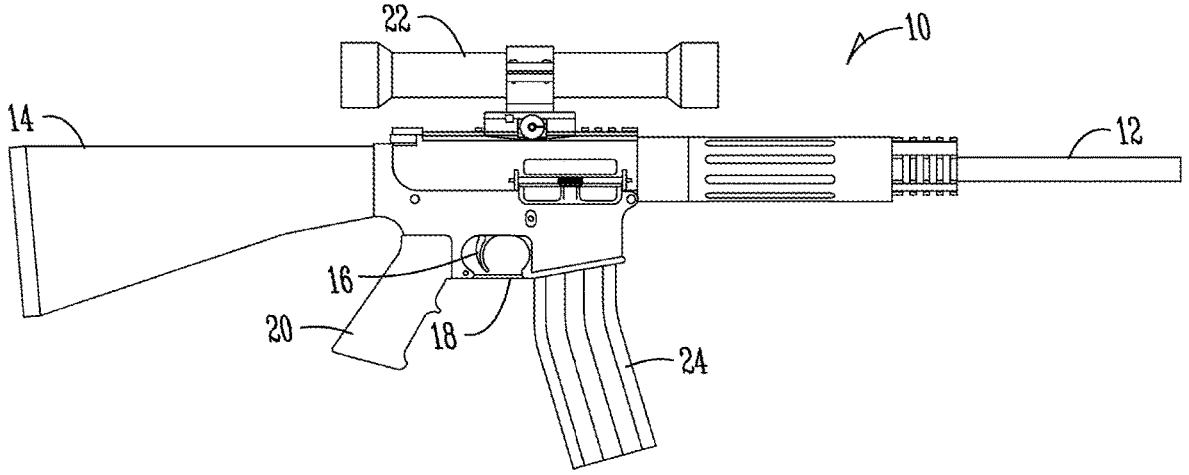
FIG. 1 is a side elevation view of a magazine-fed firearm according to one embodiment of the present invention.

An embodiment of a preferred bolt carrier and related components are described in detail with reference to the drawings, wherein like reference numerals represent like parts throughout the several views. Reference to various embodiments does not limit the scope of the invention. Figures represented herein are not limitations to the invention and are presented for exemplary illustration of the invention.

DETAILED DESCRIPTION OF THE EMBODIMENTS

FIG. 1 shows a gas-operated magazine-fed firearm 10. The firearm 10 includes standard features such as a barrel 12, buttstock 14, trigger 16, trigger guard 18, and pistol grip 20. In the embodiment shown a scope 22 has been added to the firearm 10. A removable magazine 24 is used to feed ammunition to the firearm 10. The firearm 10 could be an M16-style automatic firearm (including for example the M4 versions) as utilized by the military. It could also be an AR-15 or AR-15 style semi-automatic firearm. The advancements described herein may also be useful for other firearms that use a bolt carrier that is located directly above an ammunition magazine such that the bolt carrier can interfere with the seating of the magazine in the firearm. As used herein terms indicating relative height or vertical relation of parts refers to the orientation shown in FIG. 1, with the scope 22 or sight of the weapon above the trigger 16; forward or front refers to the barrel-end direction and rear or back refers to the buttstock-end direction.

Figure 2:
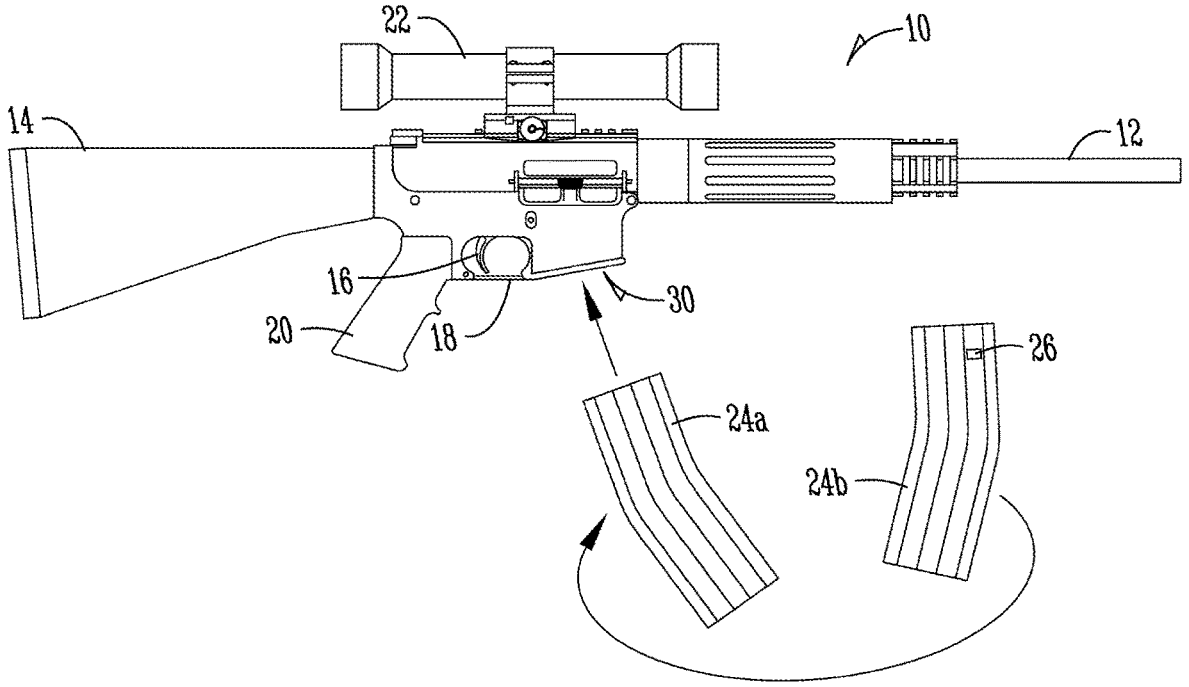
FIG. 2 is a side elevation view of the firearm of FIG. 1 with the ammunition magazine removed from the firearm and a second ammunition magazine rotated to show the rear side of the second ammunition magazine.

FIG. 2 shows the firearm 10 of FIG. 1 with a first clip 24*a* removed. A second clip 24*b* is also shown flipped to a reverse orientation to show a catch 26 that engages a latch 28 (FIG. 3) on the inner portion of a magazine well 30. To reload the firearm 10, the first clip 24*a* is removed from the magazine well 30 and the second clip 24*b* is inserted into the magazine well 30.

Figure 3:
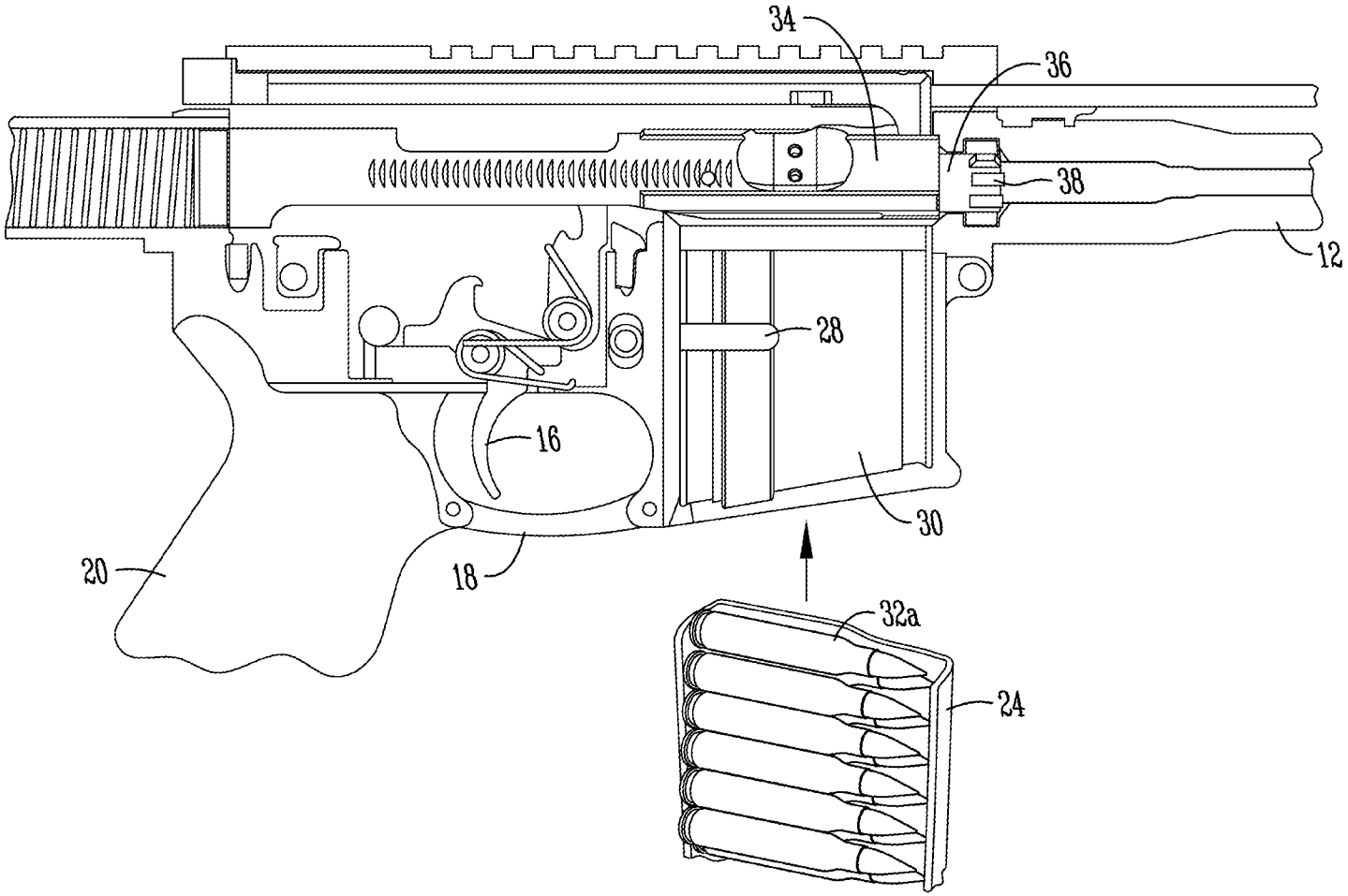
FIG. 3 is a detail partial cross section view of the firearm and first ammunition magazine of FIG. 2.

FIG. 3 is a partial cross-sectional view of the firearm 10 and magazine 24 (with the magazine apart from the firearm 10. The magazine 24 contains several cartridges 32. Cartridges 32 are loaded into the empty magazine 24 in a staggered fashion such that they are offset slightly (left and right) from the centerline of the magazine 24. In FIG. 3 the bolt carrier 34 is in a closed position such that the bolt 36, which extends from the front of the bolt carrier 34, is engaged with the barrel 12. In particular, the bolt 36 has lugs 38 that engage protrusions 40 (see FIG. 4B) at the rear of the barrel 12 to retain the bolt 36 in the closed firing position. As can be seen in FIG. 3, a lower portion of the bolt carrier 34, near the front of the bolt carrier 34, is aligned directly above the magazine well 30. Without the modification to the bolt carrier 34 described herein, the lower portion of the bolt carrier 34 can interfere with seating of the magazine 24 because the top cartridge 32*a* may contact the lower portion of the bolt carrier 34 and prevent the catch 26 on the magazine 24 from fully engaging the catch 28 in the magazine well 30.

Figure 4A:
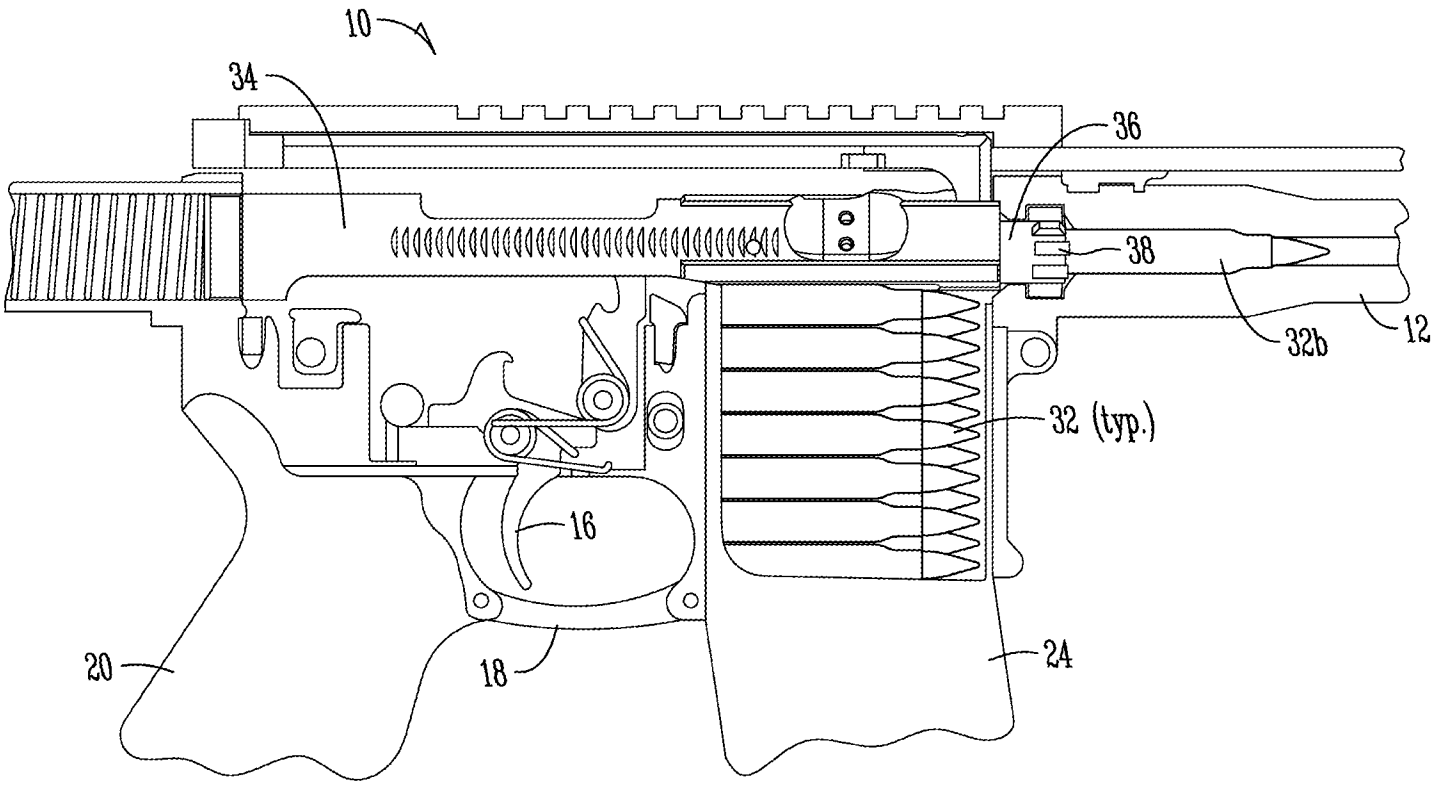
FIG. 4A shows the detail partial cross section of FIG. 3, with the first ammunition magazine seated in the magazine well of the firearm, with the bolt carrier and bolt in a closed position in engagement with firearm barrel.
Figure 4B:
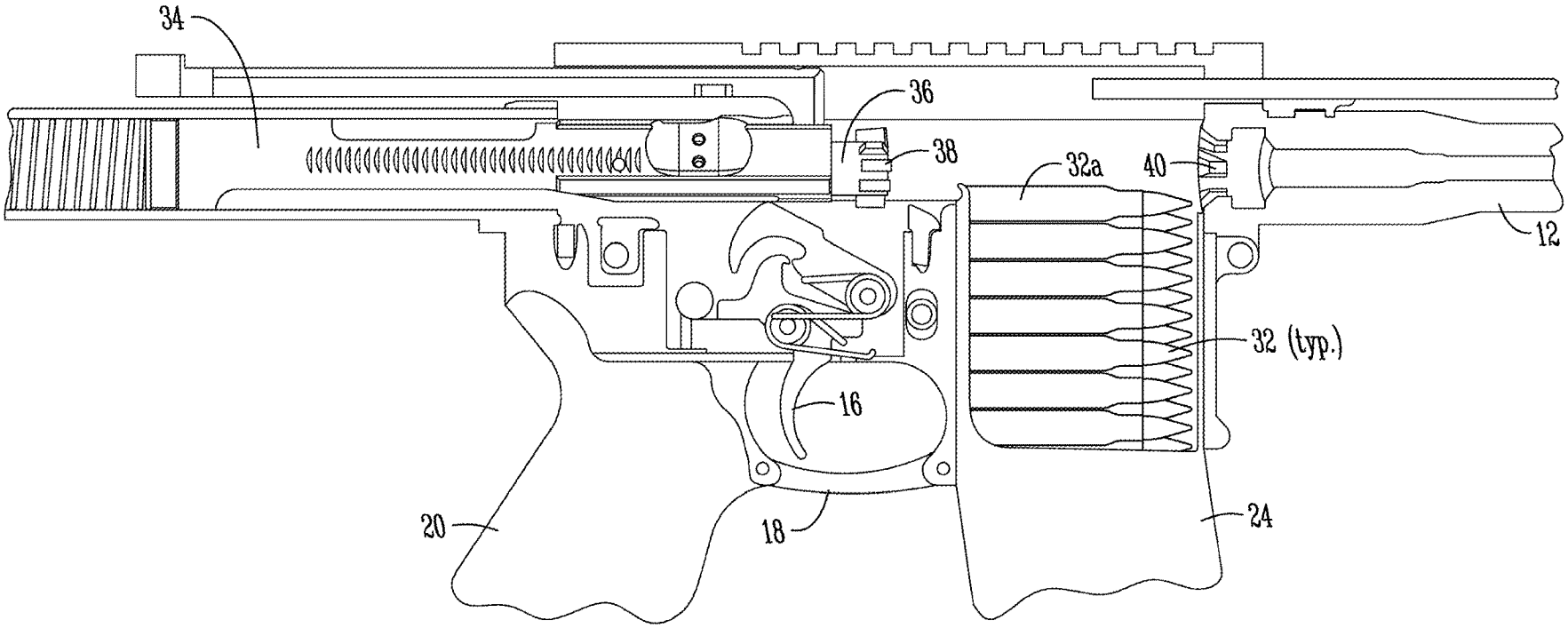
FIG. 4B shows the detail partial cross section of FIG. 3, with the first ammunition magazine seated in the magazine well of the firearm, with the bolt carrier and bolt in an open position spaced apart from the firearm barrel.

FIG. 4A is a partial cross-section view of the firearm 10 with the bolt carrier in the same closed position as FIG. 3, but with the magazine 24 fully seated in the magazine well 30. In addition, in FIG. 4A, a cartridge 32*b* has been loaded into the chamber of the barrel 12 and is ready to be fired. In FIG. 4B the cartridge 32*b* has been expelled from the chamber and the bolt carrier 34 is retracted to an open position. It should be appreciated that as the bolt carrier 34 moves from the open position of FIG. 4B back to the closed position of FIG. 4A the lugs 38 of the bolt 36 will strip off the top-most cartridge 32*a* from the magazine 24 and push it into the chamber of the barrel 12.

Figure 5:
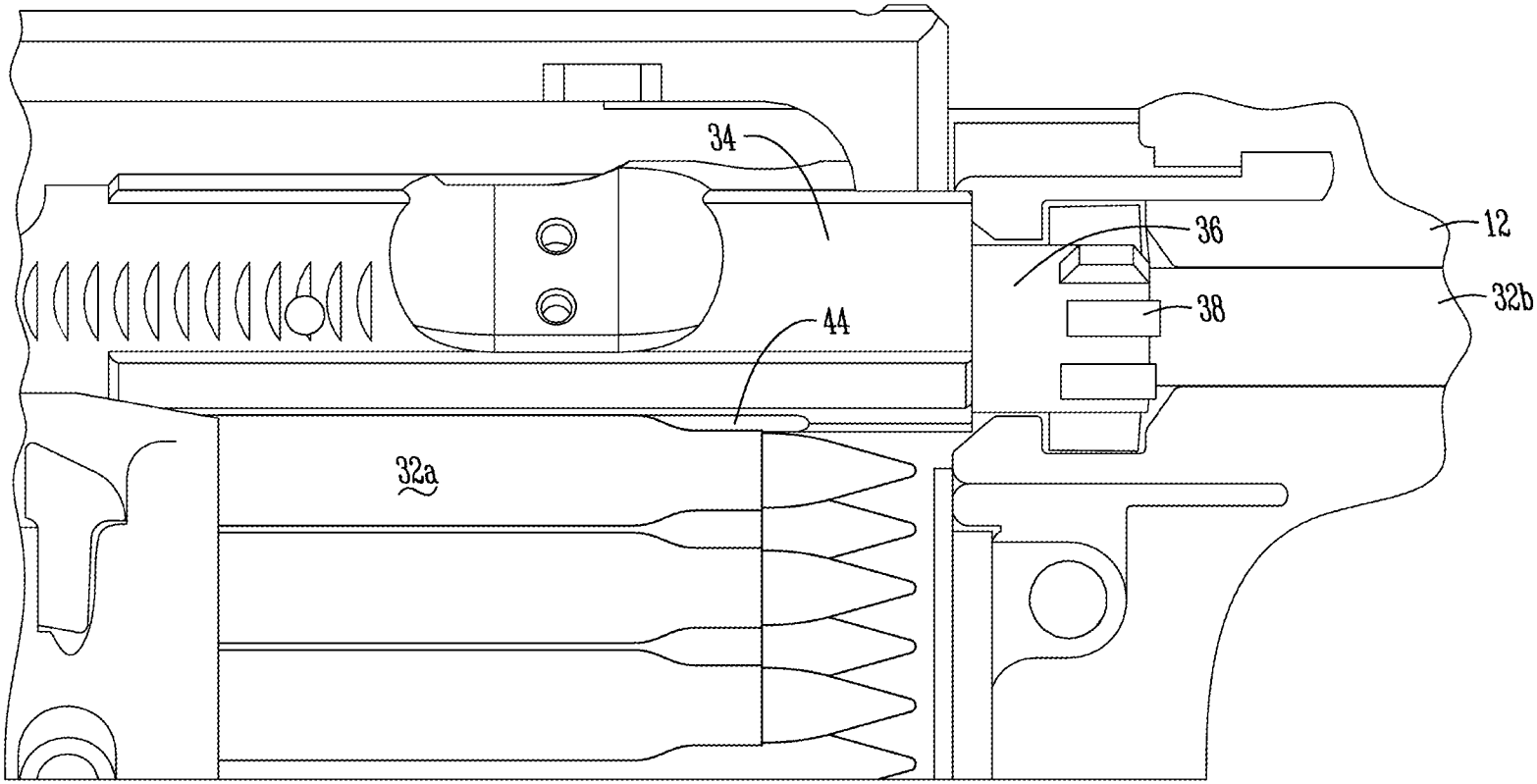
FIG. 5 is a close-up detail view of a portion of FIG. 4A.

FIG. 5 is a partial detail view of FIG. 4A with the bolt carrier 34 in a closed position with the lugs 38 of bolt 36 engaged with the barrel 12. A recessed area 44 is provide on the lower portion of the bolt carrier 34 near the front of the bolt carrier 34 to provide clearance for the upper most cartridge 32*a* in the magazine 24. This recessed area 44 thereby permits the fully loaded magazine 24 to properly seat in the magazine well 30 without interference between the uppermost cartridge 32*a* and the lower portion of the bolt carrier 34.

Figure 6:
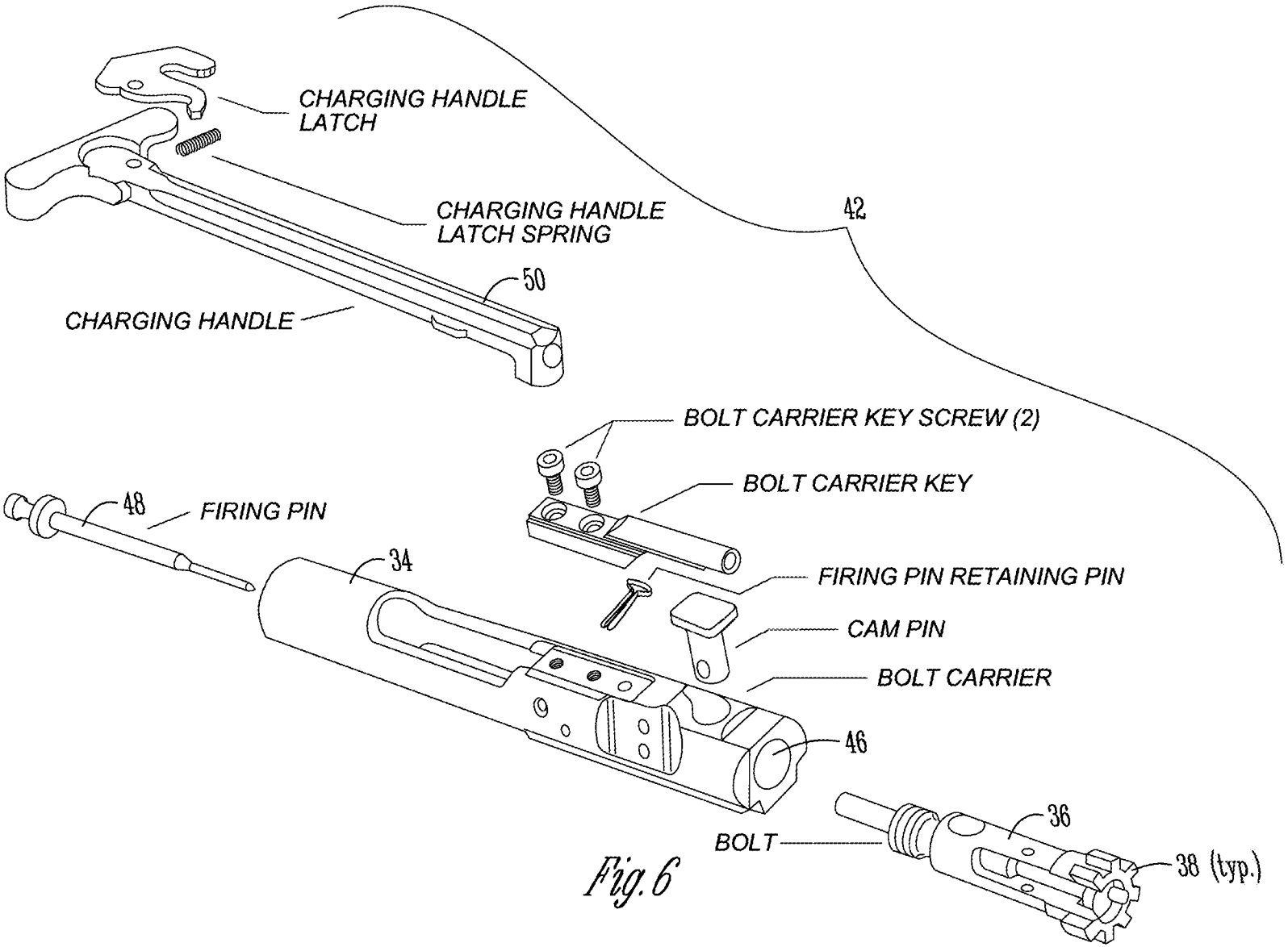
FIG. 6 is an exploded view of a bolt carrier group for use in a gas-operated magazine-fed firearm according to the present invention.

FIG. 6 is an exploded view of the bolt carrier group 42. As can be seen, the bolt 36 fits within an axial bore or passageway 46 in the front end of the bolt carrier 34. The firing pin 48 is provided in a connected passageway (not visible) at the rear of the bolt carrier 34. The firing pin 48 will extend through the front end of the bolt 38 when activated by the trigger mechanism to ignite the primer in the cartridge 32*b*. The charging handle 50 can be used to manually move the bolt carrier 34 to the open position against the force of a spring (not shown) that urges the bolt carrier 34 forward towards the barrel 12.

Figure 7:
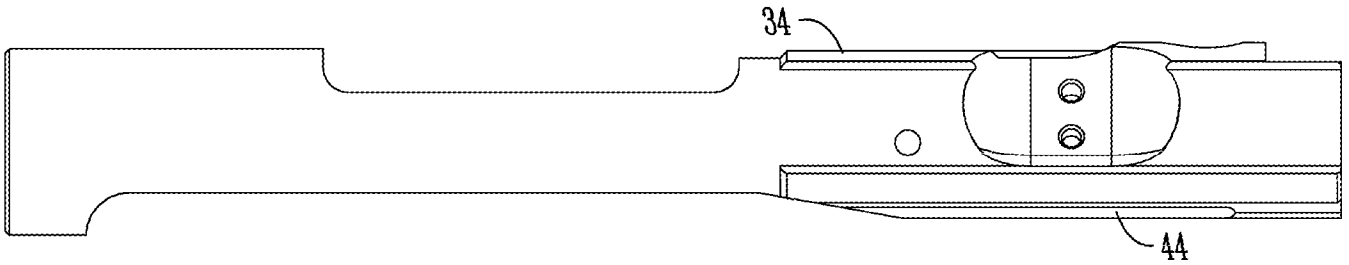
FIG. 7 is a front side elevation view of a bolt carrier according to one embodiment of the present invention.
Figure 8:
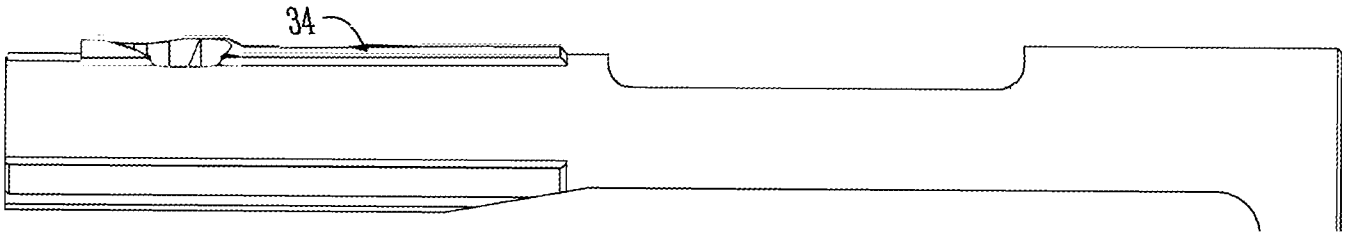
FIG. 8 is a rear side elevation view of the bolt carrier of FIG. 7.

FIGS. 7 and 8 show right and left side elevation views of the bolt carrier 34. As can be seen in FIG. 7 the recessed area 44 is provided on the lower portion of the bolt carrier 34 near the front of the bolt carrier 34 such that it will be in alignment with the upper-most round in a full magazine when the bolt carrier is in a closed position. The recessed portion 44 is provided only on the right side of the bottom of the bolt carrier 34. Accordingly, the recessed portion is not visible in the left side elevation view of FIG. 8. For this reason a user should pay attention when loading the magazine 24 to make sure the top cartridge 32*a* is on the right side of the magazine 24 to take advantage of the space provided by the recess 44.

Figure 9:
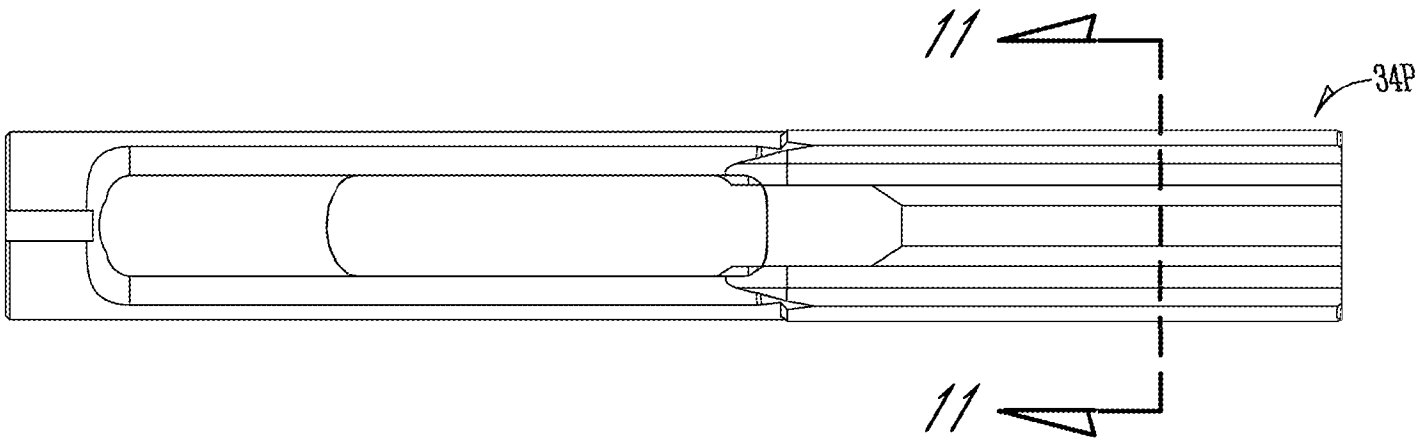
Fig. 9 (PRIOR ART)
FIG. 9 is a bottom plan view of a prior art bolt carrier.
Figure 10:
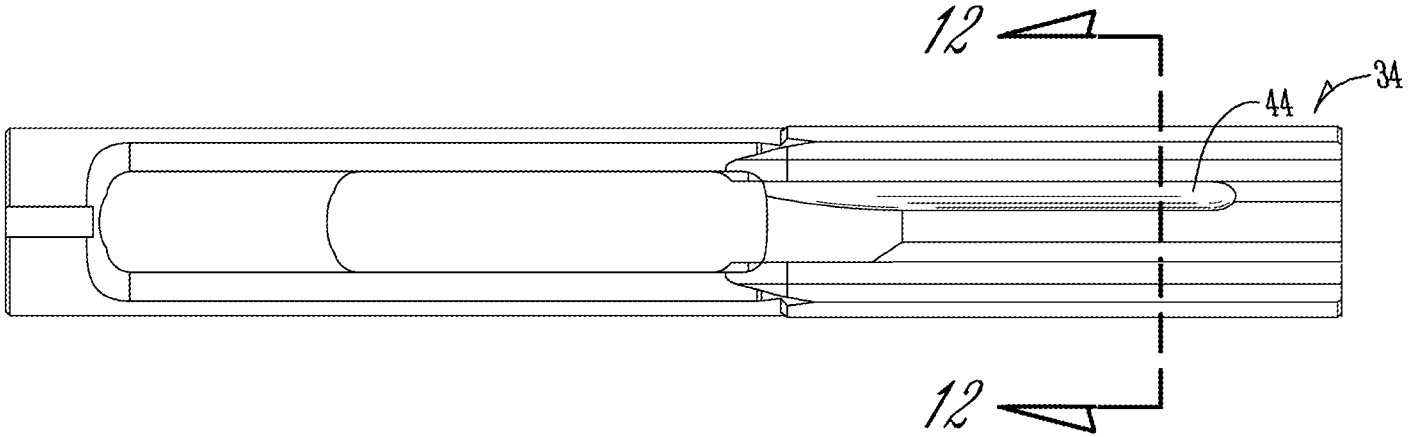
FIG. 10 is a bottom plan view of the bolt carrier of FIG. 7.

FIG. 10 shows a bottom plan view of the bolt carrier of FIG. 7. Again, the placement of the recess 44 is seen formed in the bottom of the bolt carrier 34. The recess 44 is generally elongated and parallel to the axis of the body of the bolt carrier 34. The recess 44 should be of sufficient depth and length that it prevents interference along the entire length of the upper most round 32*a* when the bolt carrier 34 is in the closed position. The recess 44 can be formed in the bolt carrier 34 during the initial machining of the bolt carrier 34. Alternatively, the recess 34 can be formed as an after-market modification to a standard bolt carrier, like the one shown in FIG. 9, to convert the standard bolt carrier to the improved bolt carrier 34 shown in FIG. 10. This is done by machining the bottom portion of the bolt carrier 34 in the appropriate location. The appropriate location can be determined by applying grease or other marking material to the top most round 32*a* in a magazine and determining where the round 32*a* contacts the bottom of the bolt carrier 34 when the magazine is loaded into the magazine well 30 with the bolt carrier 34 in the closed position.

Figure 12A:
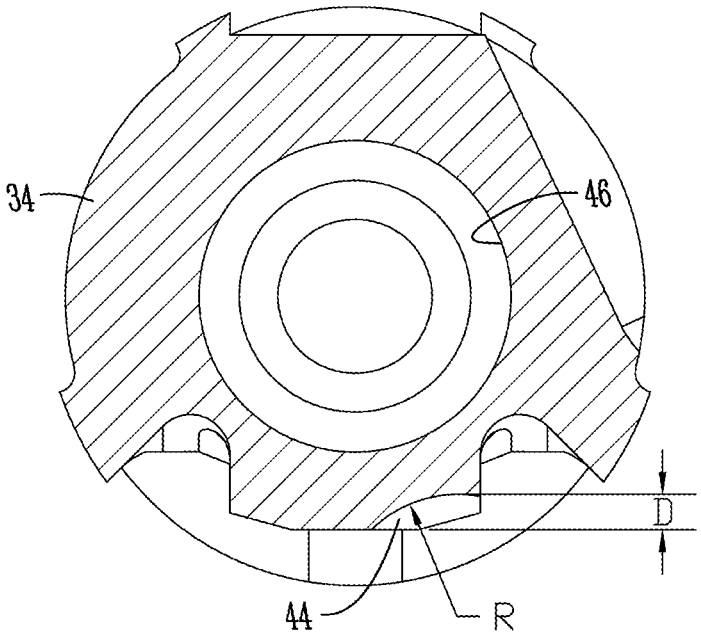
FIG. 12A is a cross-section of the bolt carrier of FIG. 10.
Figure 12B:
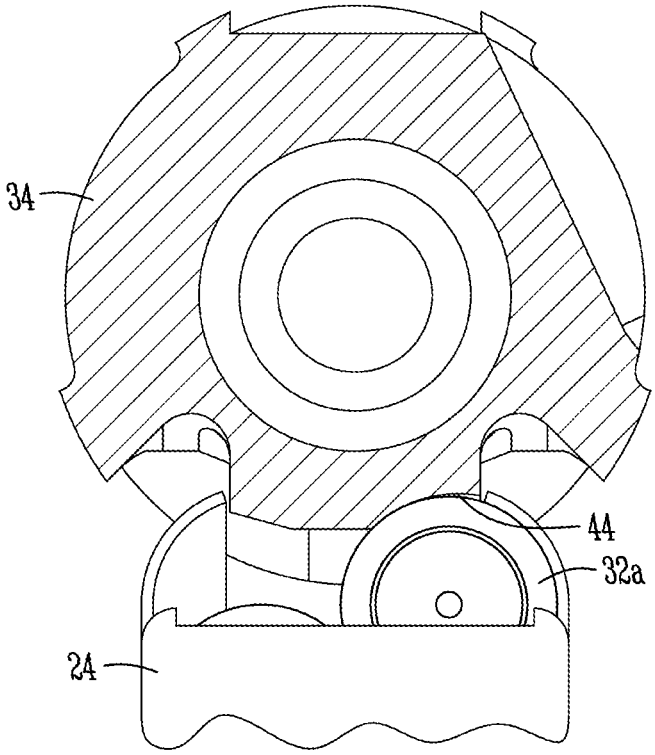
FIG. 12B is a cross-section of the prior art bolt carrier of FIG. 10, showing a top round of a full ammunition magazine nestled in a recessed portion formed in a lower surface of the bolt carrier.

FIGS. 12A and 12B are cross-section views of the front portion of the bolt carrier 34 and illustrate how the recess 44 works to avoid interference between the bolt carrier 34 and the top-most round 32*a* in a full magazine 24. The recess 44 preferably has a radius R that matches or slightly exceeds the radius of the cartridges 32. For example, for a 5.56×45 mm cartridge a radius of the recess 44 should be about 9.58 mm (0.377 inches). When a full magazine 24 is inserted in the magazine well as shown in FIG. 12B, the top cartridge 32*a* in the magazine 24 nests within the recess 44 permitting the magazine 24 to be fully inserted into the magazine well 30 (see FIG. 3). It is preferred that the recess be of sufficient depth D such that there is no contact between the top cartridge 32*a* and the bottom of the bolt carrier 34 when the magazine 24 is fully seated. However, the primary benefit of the invention may be achieved even if there is contact, provided that the recess 44 provided sufficient additional room to permit the easy insertion of the magazine 24 until the catch 26 fully engages the latch 24 (see FIGS. 2 & 3).

Figure 11A:
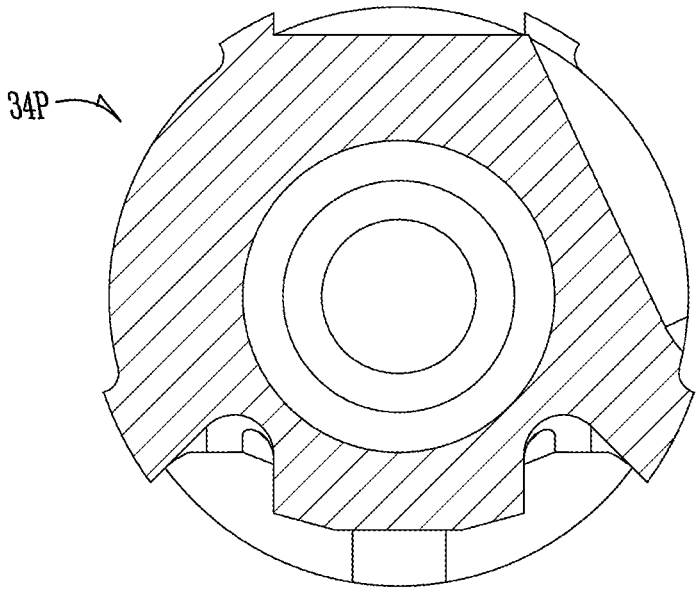
Fig. 11A (PRIOR ART)
FIG. 11A is a cross-section of the prior art bolt carrier of FIG. 9.
Figure 11B:
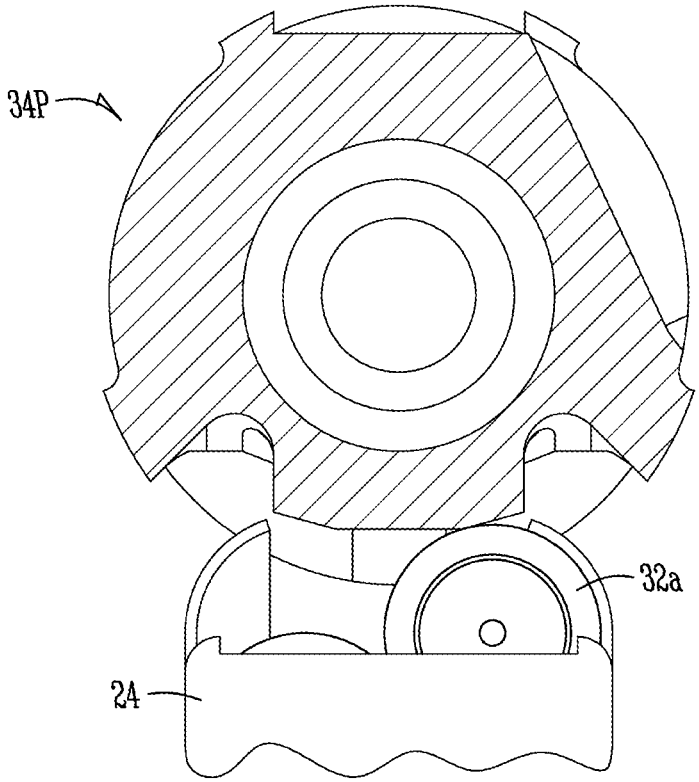
Fig. 11B (PRIOR ART)
FIG. 11B is a cross-section of the prior art bolt carrier of FIG. 9, showing a top round of a full ammunition magazine in contact with a lower surface of the bolt carrier.

FIGS. 11A and 11B illustrate the difficulty with prior art bolt carriers 34*p*. As best seen in FIG. 11B, the top cartridge 32*a* in a full magazine 24 contacts the bottom of the bolt carrier 34*p* and is prevented from fully seating in the magazine well 30.

In use the features described herein permit quick and easy loading of a full magazine 24 into a firearm 10 even with the bolt carrier 34 in a closed position. This can be especially important in emergency or combat situations when it is not desirable or feasible to reload with the bolt carrier in an open position. The features permit a user to carry more ammunition in fewer magazines by eliminating the need to underload the magazines. It also facilitates quieter reloading with a round in the chamber and the bolt carrier in a closed position. The features can be added as an aftermarket improvement to existing bolt carriers or as in improved design for new firearms or new replacement bolt carriers.

Thus, various configurations of seed delivery systems have been shown and described. It should be appreciated that the systems shown and described are for exemplary purposes, and the invention of a controlled system for delivering seed from a singulating seed meter to the ground to provide for consistent and equidistant spacing of the seed in the ground has thus been provided. It is to be contemplated that numerous variations, changes, and otherwise, which are obvious to those skilled in the art are to be considered part of the present invention. For example, while the embodiment shown shows use with an AR-15 style bolt carrier, other similar firearms may benefit from the same feature.

What is claimed is:

1. A bolt carrier for a firearm wherein the firearm includes a barrel having a loading end and a firing end opposite from the loading end, the firearm further having a magazine well for receiving and seating a magazine containing cartridges, wherein the bolt carrier slides between an open position wherein a bolt is moved away from the barrel and a closed position wherein the bolt is at the loading end of the barrel, and further wherein when the bolt carrier is in the closed position at least a portion of the bolt carrier is aligned directly above the magazine well, the bolt carrier comprising:

an elongated body having a front end with an axial bore for retaining a portion of the bolt;

a lower surface of the elongated body proximate to the magazine well when the bolt carrier is in the closed position; and a recessed portion in the lower surface located to be aligned with a top cartridge in the magazine when the magazine is fully loaded with the cartridges and received within the magazine well such that the top cartridge nests partially within the recessed portion when the bolt carrier is in the closed position.

2. The bolt carrier of claim 1, wherein the recessed portion has a sufficient depth such that contact between the top cartridge and the lower surface of the elongated body does not interfere with seating the magazine in the magazine well.

3. The bolt carrier of claim 1, wherein the recessed portion has a radius equal to or greater than a radius of the cartridges.

4. The bolt carrier of claim 1, wherein the recessed portion is laterally offset from a centerline of the elongated body in order to be in alignment with the top cartridge.

5. The bolt carrier of claim 1, wherein the firearm is a gas-operated firearm.

6. The bolt carrier of claim 5, wherein the firearm is an AR-15 style firearm.

7. The bolt carrier of claim 5, wherein the firearm is an M16-style firearm.

* * * * *